US006029103A

United States Patent [19]

Faubel et al.

[11] Patent Number: 6,029,103

[45] Date of Patent: Feb. 22, 2000

[54] METHOD OF CHECKING TRAIN-ANNOUNCEMENT DATA SETS VIA A COMPOSITION OF A VEHICLE

[75] Inventors: Peter Faubel, Königslutter; Hans-Joachim Kraas, Lehrte; Wolfgang Talke, Blankenburg, all of Germany

[73] Assignee: Siemens Aktiengesellschaft, Munich, Germany

[21] Appl. No.: 08/894,487

[22] PCT Filed: Feb. 23, 1996

[86] PCT No.: PCT/DE96/00346

§ 371 Date: Dec. 29, 1997

§ 102(e) Date: Dec. 29, 1997

[87] PCT Pub. No.: WO96/26857

PCT Pub. Date: Sep. 6, 1996

[30] Foreign Application Priority Data

Feb. 28, 1995 [DE] Germany ..... 195 08 730

[51] Int. Cl.[7] ..... B61L 17/02

[52] U.S. Cl. ..... 701/19; 701/20; 246/2 R; 246/3; 246/4; 246/5; 246/124

[58] Field of Search ..... 701/19, 20; 246/2 R, 246/3, 4, 5, 124

[56] References Cited

FOREIGN PATENT DOCUMENTS

| | | |
|---|---|---|
| 1605429 | 4/1971 | Germany . |
| 2017844 | 10/1971 | Germany . |
| 42-57087 | 9/1992 | Japan . |

OTHER PUBLICATIONS

R. Grolms et al., "Der Intelligente Güterwagen", Transport– und Umnschlagetechnik, vol. 54, 1994, month unknown.

*Primary Examiner*—William A. Cuchlinski, Jr.
*Assistant Examiner*—Yonel Beaulieu
*Attorney, Agent, or Firm*—Kenyon & Kenyon

[57] ABSTRACT

At least one individual car that can be identified individually is contained in the consist. The configuration of an actually observed consist is determined and checked to see whether it matches relevant information data sets. If there is an exact match with one information data set, the latter is assigned to the consist. If there are multiple matches or no matches, the information data set associated with the consist is determined by identification of the individual car.

5 Claims, 2 Drawing Sheets

| | | | | | | | | | | | | | | |
|---|---|---|---|---|---|---|---|---|---|---|---|---|---|---|
| AKON | 3 | 2 | 1 | 5 | 1 | 2 | 3 | 2 | 1 | 4 | 1 | 2 | 3 | Σ14 Axles |
| VM1 | 1 | 5 | 1 | 2 | 3 | 2 | 3 | 2 | 1 | 4 | 1 | 2 | 3 | Σ14 Axles |
| AKON | 3 | 2 | 1 | 5 | 1 | 2 | 3 | 2 | 1 | 4 | 1 | 2 | 3 | Σ14 Axles |
| VM2 | 3 | 2 | 1 | 5 | 1 | 2 | 3 | 2 | 1 | 4 | 1 | 2 | 3 | Σ14 Axles |
| AKON | 3 | 2 | 1 | 5 | 1 | 2 | 3 | 2 | 1 | 4 | 1 | 2 | 3 | Σ14 Axles |
| VM4 | 3 | 2 | 1 | 5 | 1 | 2 | 3 | 2 | 1 | 4 | 1 | 2 | 3 | Σ14 Axles |

METHOD OF CHECKING TRAIN-ANNOUNCEMENT DATA SETS VIA A COMPOSITION OF A VEHICLE

FIELD OF THE INVENTION

The present invention relates to a method for checking train information data sets for a composition of a consist.

BACKGROUND INFORMATION

A classification involves rearranging consists arriving from a starting location up the line into new consists in accordance with specified guidelines for splitting up the consist. For example, a train can be separated into hierarchic units, with the most comprehensive unit consisting of the train itself (possibly including the locomotive) and a subgroup of nonpowered cars. The smallest unit to be handled consists of an individual vehicle (car). For this purpose, a consist to be processed must be correctly identified. The individual composition of the consist can be provided in advance to the classification yard in question. For this purpose, informational data sets can be transmitted from the location where the consist was initially assembled via the stations through which the consist will pass on its way to the classification yard. In addition, informational data sets can be determined at a station up the line. Since a plurality of consists usually enters a classification yard, the yard must deal with a plurality of train information data sets that arrive. An important prerequisite for properly separating the cars and forming these cars into new consists in each case involves assigning to the consist as it arrives, out of the plurality of informational data sets, the particular data set that actually represents the configuration of that consist.

German Patent Application No. 30 36 472 describes (when identifying individual wobbling cars by type) a process in which the actual play is compared with the normal play of a retarder as it operates. Although this method makes it basically possible to detect cars that exhibit a wobbling behavior, individual identification of a certain car or consist is not possible.

German Patent Application No. 29 31 085 describes a device for determining the number of axles of the cars in a consist, these cars not being equipped together with an effective marking, with other cars equipped with effective markings. The determination of the number of axles in a consist is a first important criterion for identifying a consist. Used alone, however, this method only provides limited identification form, so that it is possible that an improper identification of the consist can be made. Improperly identified consists may be assigned an incorrect information data set which then results in an incorrect division of the consist. The correction that is then necessary involves considerable expense and time.

East Germany Patent Application No. 229 657 describes a method for determining the number of cars, the distance between axles, the lengths of the individual cars, and the total length of a consist. Using two track switches, arranged with a distance between them that is shorter than the shortest distance between axles in a truck, the axle intervals are determined from the average axle speeds and the time intervals between the passages of axles over the track switches. The axle intervals thus determined are compared with predetermined type-specific reference values to determine the type of car.

European Patent Application No. 0 433 756 describes a system for monitoring and controlling freight cars, with each individual freight car being equipped with an individual identification marking. Although this system provides clear identification of the smallest subunit (e.g. individual car) and thus providing a very high identification probability, equipping all of the cars in an existing fleet with suitable individual identification markings is unacceptable from a economic standpoint and also cannot be carried out immediately.

One of the objects of the present invention is to provide a method for checking information data sets whose reliability in assigning a given set of information data to a given consist is considerably improved and can be practically applied to a small number of individually identifiable individual cars, especially during an introductory phase of after retrofitting in which individual identification markings are applied or in the case of frequent failure of other suitable identification methods. The method is also intended to permit monitoring of the information data sets.

SUMMARY OF INVENTION

A method according to the present invention is provided for checking at least one information data set for a composition of a consist with at least one individual car being identified individually, wherein the configuration of a currently observed consist is determined and checked for correspondence with the configuration according to the respective information data set, and when precise correspondence with one information data set is achieved, the latter is assigned to the observed consist, and when there is no match, an error message is generated, and in the event of multiple mismatches or no matches at all, the information data set is assigned to the observed consist that includes the individually identified single car, and an error message is generated if the information data set assigned as a function of the match does not include the individually identified single car.

One of important advantages of the method according to the the present invention is that the configuration determined for the consist under observation as a function of the additional identification of at least one individual car in the consist is used both for monitoring and/or retroactive correction if an information data set has already been assigned and for making decisions in the case of ambivalent or uncertain assignment possibilities. The method according to the present invention thus permits introduction of individual identification in stages, with even a small number of cars already so equipped resulting in a considerable increase in the reliability of identification of the consist. The method according to the present invention also introduces methods for identifying individual cars whose typical error rates these individuals cars being used alone. The individual cars are preferably equipped with individual identification markings and can be identified automatically.

Another embodiment of the method according to the present invention for determining the configuration of the consist includes determining such configuration as a function of a number of axles and an axle interval. The recognition criteria that can be derived may be one advantageous embodiment of the invention, can be further improved by determining and using the sequence of the cars.

Especially flexible and reliable identification of the individual cars is made possible according to yet another embodiment according to the present invention since a surface wave reflector is used as the car-specific identification marking, such reflector described in the article "Der intelligente Güterwagen," by ("The Intelligent Freight Car") R. Grolms and M. Jung in Transport—und Umschlagtechnik, Vol. 54, 1994. An alternative identification principle can also include a video identification of the individual car numbers, in which the a comparatively small number of individual cars can be sufficiently identified, due to the car numbers being obscured by dirt for example. As a result, video identification methods can be used with error rates of about 50%, which would be unsuitable if used alone for reliable identification of a consist.

DETAILED DESCRIPTION OF THE INVENTION

Figure 1:
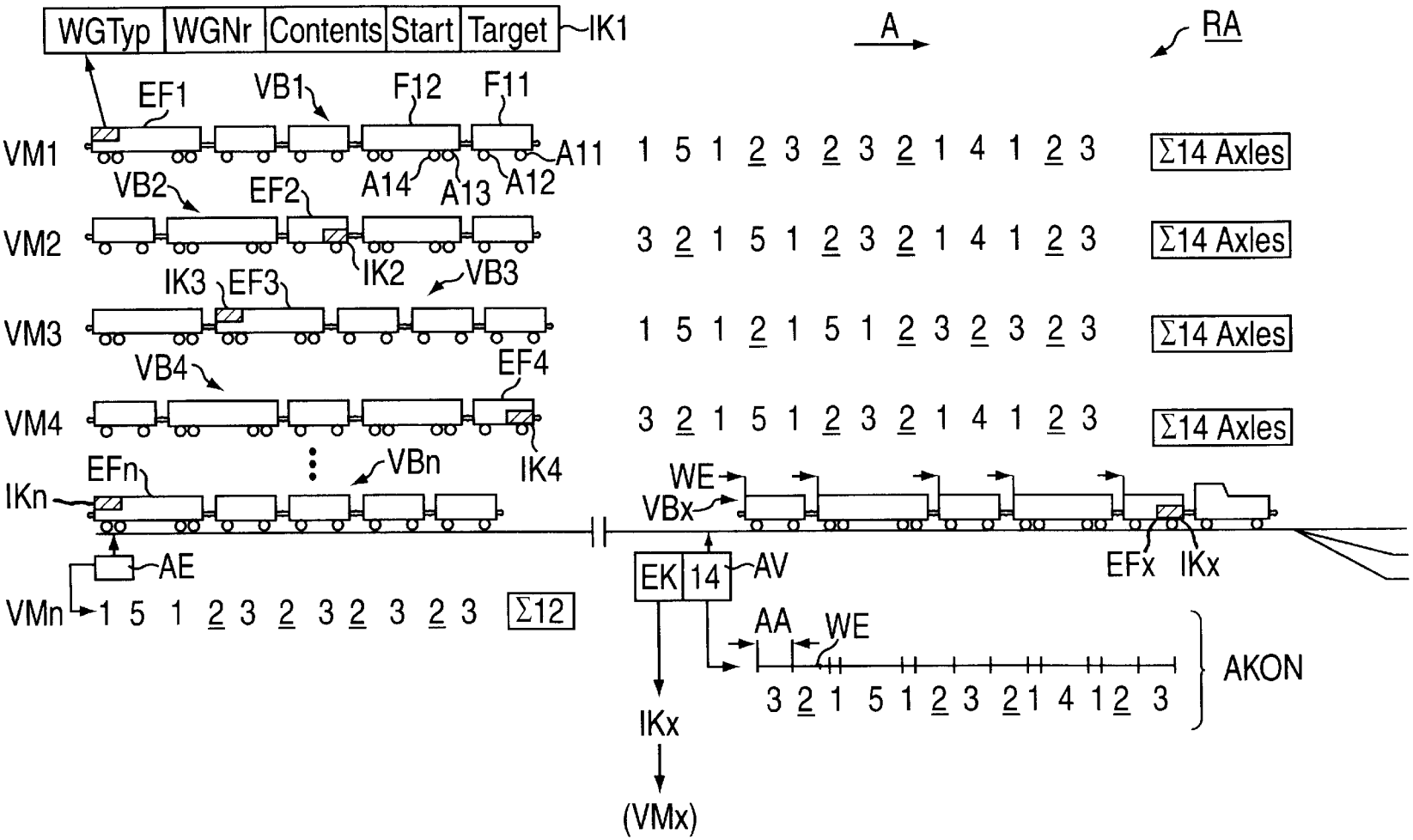
FIG. 1 shows a classification yard operated using a method according to the present invention.

FIG. 1 shows a plurality of consists VB1, VB2, VB3, VB4 through VBn whose configurations by consist are determined in advance and are each represented in the form of information data sets VM1, VM2, VM3, VM4 through VMn. The configurations formed when the consists are initially assembled can be recorded and passed on as the consist travels from station to station or can be recorded for example at a detection station located up the line from a classification yard RA. Each consist VB1 through VBn (located anywhere in the train) at least one individual car EF1, EF2, EF3, EF4 through EFn that can be identified individually by an individual identification marking IK1 to IKn. The identification marking, IK1 for example, contains information about the type of car and the car number so that each individual car EF is clearly identified. In addition, the identification characteristics can contain additional information about e.g., contents, origin, and destination of the individual car (EF1 for example) or its consist (VB1 for example).

Information data sets VM1 to VMn contain information about the axle interval AA. This information is shown in FIG. 1 as dimensional numbers that indicate the individual relative spacings of adjacent axles. For example, the distance between the first two axles A11 and A12 in the first car F11 in consist VB1 is "3" and the distance between the last axle A12 of the first car F11 and the first axle A13 of the following car F12 is "2". In similar fashion, the other axle intervals in consist VB1 and in all the other consists can be determined. In addition, the car ends WE (e.g. car sequence) are detected in travel direction A and included in each set of information data. The distances between axles at the ends of the cars are underlined. Thus, for example, axle interval "2" is underlined between axles A12 and A13 of consist VB1. Alternatively, with a continuous numbering of the axles, the axles at the ends of the cars can be characterized individually. In addition, the information data sets VMn each give the total number Z of axles in a given consist. The axle configurations are determined in advance as the consist passes a recording unit AE located up the line, as described in, e.g., East German Patent Application No. 229 657, as indicated for consist VMn.

Information data VMn are transmitted to classification yard RA which has an evaluation and comparison unit AV. The evaluation unit AV determines the axle configuration in a suitable manner for consist VBx that is currently under observation, with the total number of axles, the axle interval AA, and the axles at the car ends being determined. Then the current configuration 3215123214123, referred to as AKON (total number $\epsilon$: 14) can be obtained. In addition, a recognition device EK is provided for individual identification markings IK.

Figures 2, 3:
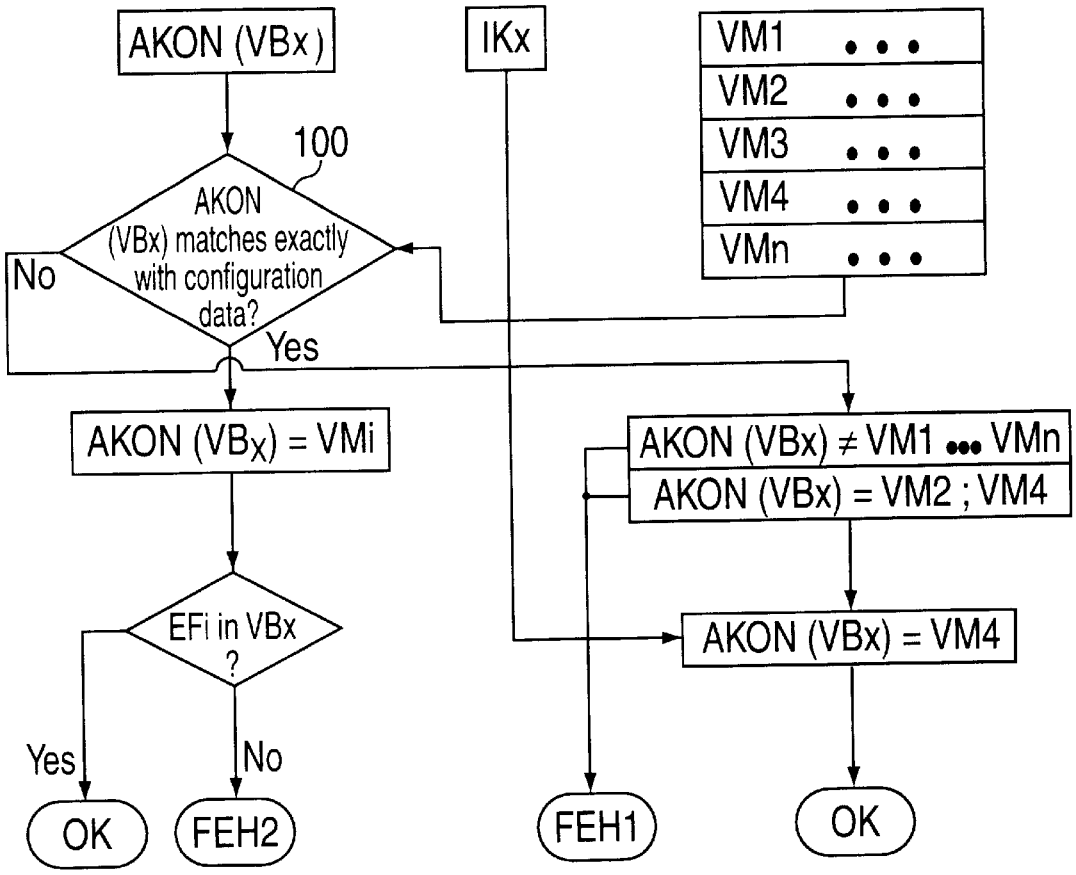
FIG. 2 shows a comparison of a current consist with relevant information data sets.
FIG. 3 shows a schematic flowchart of the method according to the present invention.

As shown in FIG. 2, the current AKON configuration is then compared in comparison device AV (shown in FIG. 1) with the information data VM in question. Although there is a match when comparing the total number $\epsilon$ of axles (14 axles in each case) between the current AKON configuration of consist VBx and the first set of information data VM1, the actual configuration differs considerably from information data set VM1 as far as the axle intervals and car ends are concerned (car sequence). Information data VM1 are therefore rejected as incorrect for consist VBx. In addition, the comparison (not shown in FIG. 2) of information data VMn and the actual configuration shows a considerable difference as far as the total number of axles (12/14) is concerned. FIG. 2 shows that only two information data sets VM2 and VM4 are shown, both of which, as far as the total number of axles, axle intervals, and car ends are concerned, show a complete match with the actual AKON configuration. In order for the configuration of the currently observed consist to be available, a manual determination must be made immediately as to which consist is actually involved, VM2 or VM4. By additional evaluation of identification markings IKx on the first car EF of the consist being observed, VBx, not only is the first car individually identified but this information can be used to draw conclusions regarding all of consist VBx. The individual car EF4 (shown in FIG. 1), because of the clearly identified car number and car position, leads to the conclusion that this can only be consist VB4 according to information data set VM4. Only this consist VM4 has in its first position the individual car EF4 which corresponds to the first car EFx of consist VBx not only as far as its axle configuration is concerned but also in terms of its car number. For individual identification, surface wave reflectors known of themselves can be used as identification markings IK. Alternatively, video detection can be provided for optical scanning and identification of individual car numbers.

As an alternative, it may be necessary for the information data sets to include information data VM4. In this case, according to the comparison described with respect to FIG. 2 information data set VM2 is assigned to consist VBx that corresponds in terms of its axle configuration and the total number of axles to the current AKON configuration. While verifying the identification marking IKx, it would also become apparent that it was not individual car EF2 but another individual car EFx that was identified in consist VBx. Accordingly, an error message FEH2 would be generated, indicating that an improper has been received and thus preventing subsequent improper handling of consist VBx.

The relationships described above can be summarized in a flowchart shown in FIG. 3. In a first step 100, the currently determined AKON configuration of current consist VBx (shown as AKON (VBx)) is compared with applicable information data VM1 to VMn reported earlier. If this comparison produces an exact match, consist VBx is initially assigned the corresponding information data set VMi (AKON (VBx)=in step 105). If on the other hand there is no match (n) or a multiple (n) match [AKON (VBx))≠VM1 to VMn or AKON (VBx)=VM2 and VM4], the information associated with the observed consist VBx is determined by individual identification of an individual car. If query 110 an assignment was not possible because the identified individual car EFx was not included in any of the applicable information data sets VM2 or VM4, an error message FEH1 is generated just as if there is no match. According to the case shown in FIG. 2, information data set VM4 is assigned to consist VBx. If there is a definite match (determined in query 100), an additional test is performed (in query 110) to determine whether the individual car EFi to be expected in consist VBx according to identification marking IKx actually is contained in consist VBx. If this is the case, it can be decided with a high degree of reliability that the current consist has been correctly identified and it can be concluded that an appropriately correct assignment of the information data has been made (OK). Otherwise, an error message FEH2 is output (in step 115) on the basis of which an improper division of consist VBx is prevented or is detected later and corrected retroactively.

We claim:

1. A method for checking at least one information data set for a composition of at least one consist, comprising the steps of:

determining a first configuration of a currently observed consist of the at least one consist;

comparing the first configuration of the currently observed consist with a second configuration corresponding to the at least one information data set;

if the first configuration precisely corresponds to the second configuration, assigning the second configuration to the first configuration of the currently observed consist;

if the first configuration does not match the second configuration, generating a first error message;

if the first configuration does not match the second configuration or if more than one configuration matches the second configuration, assigning a third configuration corresponding to a first data set of the at least one information data set to the first configuration of the currently observed consist, the first data set including at least one individually identified car; and if the first configuration precisely corresponds to the second configuration and if the currently observed consist does not include the at least one individually identified car, generating a second error message.

2. The method according to claim 1, further comprising the step of:

determining a number of axles and axle intervals to form the at least one information data set and to determine the first, second and third configurations.

3. The method according to claim 2, further comprising the step of:

determining a car sequence to further form the at least one information data set.

4. The method according to claim 1, wherein the individually identified car includes a surface wave reflector for providing a car-specific identification marking.

5. The method according to claim 1, further comprising the step of:

identifying a complete car number of the at least one individually identified car using a video identification system.

* * * * *